US010753213B2

(12) United States Patent
Pernleitner et al.

(10) Patent No.: US 10,753,213 B2
(45) Date of Patent: Aug. 25, 2020

(54) WEAR-RESISTANT SHIELD FOR A ROTATING BLADE OF A GAS TURBINE

(71) Applicant: MTU Aero Engines AG, Munich (DE)

(72) Inventors: Martin Pernleitner, Dachau (DE); Rudolf Stanka, Rattenkirchen (DE); Manfred Dopfer, Unterschleissheim (DE)

(73) Assignee: MTU Aero Engines AG, Munich (DE)

( * ) Notice: Subject to any disclaimer, the term of this patent is extended or adjusted under 35 U.S.C. 154(b) by 161 days.

(21) Appl. No.: 15/964,332

(22) Filed: Apr. 27, 2018

(65) Prior Publication Data

US 2018/0320535 A1 Nov. 8, 2018

(30) Foreign Application Priority Data

May 3, 2017 (DE) ..... 10 2017 207 445

(51) Int. Cl.
*F01D 5/30* (2006.01)
*F04D 29/32* (2006.01)

(52) U.S. Cl.
CPC ..... *F01D 5/3092* (2013.01); *F04D 29/322* (2013.01); *F04D 29/324* (2013.01); *F01D 5/3007* (2013.01); *F05D 2220/323* (2013.01); *F05D 2240/24* (2013.01); *F05D 2250/711* (2013.01); *F05D 2260/30* (2013.01)

(58) Field of Classification Search
CPC . F01D 5/32; F01D 5/323; F01D 5/326; F01D 5/30; F01D 5/3007; F01D 5/3015; F01D 5/3092; F01D 5/16; F04D 29/34; F04D 29/38; F04D 29/322; F04D 29/324; F05D 2220/323; F05D 2240/24; F05D 2250/711; F05D 2260/30
USPC ..... 416/219 R, 224
See application file for complete search history.

(56) References Cited

U.S. PATENT DOCUMENTS

| | | | | |
|---|---|---|---|---|
| 4,207,029 | A | 6/1980 | Ivanko | |
| 2009/0081046 | A1* | 3/2009 | Mace | F01D 5/3007 416/219 R |
| 2016/0024947 | A1* | 1/2016 | Murdock | F01D 5/147 416/219 R |

FOREIGN PATENT DOCUMENTS

| | | | |
|---|---|---|---|
| DE | 889160 | B | 9/1953 |
| DE | 102013214933 | A1 | 2/2015 |
| EP | 2042689 | A1 | 4/2009 |
| EP | 2719864 | A1 | 4/2014 |
| EP | 2719865 | A1 | 4/2014 |
| EP | 2873808 | A1 | 5/2015 |
| FR | 2951494 | A1 | 4/2011 |

(Continued)

*Primary Examiner* — Woody A Lee, Jr.
*Assistant Examiner* — Justin A Pruitt
(74) *Attorney, Agent, or Firm* — Barlow, Josephs & Holmes, Ltd.

(57) ABSTRACT

The invention relates to a wear-resistant shield for a rotating blade root of a rotating blade of a gas turbine, especially an aircraft gas turbine, having a base and two side walls connected to the base, wherein the side walls lie opposite each other and are shaped so as to be substantially complementary to an outer contour of a particular rotating blade root, and wherein the wear-resistant shield for this purpose is set up in such a way that, in an installed state, it is to be taken up between the respective rotating blade root and a rotating blade root mount of a rotor, especially between the respective rotating blade root and an axial securing element arranged in the rotating blade root mount.

10 Claims, 3 Drawing Sheets

(56) References Cited

FOREIGN PATENT DOCUMENTS

| | | | |
|---|---|---|---|
| WO | 0233224 | A1 | 4/2002 |
| WO | 2016059338 | A1 | 4/2016 |

* cited by examiner

WEAR-RESISTANT SHIELD FOR A ROTATING BLADE OF A GAS TURBINE

BACKGROUND OF THE INVENTION

The present invention relates to a wear-resistant shield for a rotating blade root of a rotating blade of a gas turbine, especially an aircraft gas turbine, with a base and two side walls connected to the base, wherein the side walls lie opposite each other and are shaped so as to be formed substantially complementary to an outer contour of a respective rotating blade root, and wherein the wear-resistant shield for this purpose is set up in such a way that, in an installed state, it is to be taken up between the respective rotating blade root and a rotating blade root mount of a rotor, especially between the respective rotating blade root and an axial securing element arranged in the rotating blade root mount.

Direction terms such as "axial" or "axially", "radial" or "radially" and "peripheral" should be understood to refer principally to the machine axis of the gas turbine, unless otherwise inferred implicitly or explicitly from the context.

The providing of a wear-resistant shield between a rotating blade root and a rotating blade root mount of a rotor is known in and of itself. The wear-resistant shield serves in particular to avoid wear on the rotating blade root and on the rotating blade root mount, so that after a specified running time of the gas turbine generally only the wear-resistant shields need to be replaced.

However, it has been found that wear-resistant shields often slip during insertion, so that an unwanted overhang may arise between the rotor (rotor disk) and a respective rotating blade. Accordingly, it is necessary to straighten out the slipped wear-resistant shields, but this may generally result in damage to the wear-resistant shields. In the worst case scenario, this may result in an entire rotating blade ring having to be removed and all wear-resistant shields replaced.

From WO2016059338A1 there is known a wear protection film for a compressor blade, which is mounted on a blade root in the peripheral direction and which protrudes beyond the blade root in the mounted state, both in the peripheral direction and in the axial direction.

SUMMARY OF THE INVENTION

The object of the invention is to provide a wear-resistant shield in which the installation is improved, so that damage to the wear-resistant shield can be prevented.

To achieve this object, it is proposed that the side walls in the wear-resistant shield project at least at one of their axial ends by a respective lateral end section beyond an axial end region of the base, and that a guide section adjoins the axial end region of the base, the guide section starting from the base and arcing in the direction of the axial lateral end section of the side walls.

Due to its arced shape, the guide section facilitates the insertion into the rotating blade root mount.

A slippage can be prevented in this way.

Because at least at one of their axial ends, preferably the end with the arced guide section, the side walls project by a respective lateral end section beyond an axial end region of the base, it is furthermore possible to prevent an axial overhang of the wear-resistant shield beyond the rotor disk and/or the rotating blade root taken up in a groove, especially an axial groove, of the rotor disk. In other words, the wear-resistant shield can be arranged entirely within the disk groove, and, in this case, at the same time, the rotating blade root can end axially flush with the rotor disk at one or both ends, without an overhang of the wear-resistant shield, even if only for a portion, beyond the rotating blade root and/or beyond the rotor disk.

As an enhancement, it is proposed that the guide section is arced in such a way that it has substantially the same curvature as a rotating blade root region in contact with or coming into contact with the guide section.

In this way, a region of a form-fitting abutment or a form-fitting connection is produced between the guide section and the rotating blade root.

The guide section may have a projected length, in terms of a projection onto the axial direction, corresponding to approximately 0.75 to 1.0 times a radius by which the guide section is arced. In this way, the guide section does not project in the axial direction beyond the axial ends of the lateral end section.

Moreover, the guide section may be situated at an axial inserting end of the rotating blade root, so that the wear-resistant shield and the associated rotating blade root can be moved together in the axial inserting direction relative to the respective rotating blade root mount of the rotor. Thanks to the already mentioned form fit connection or form fit bearing against one another, the wear-resistant shield is carried along by the rotating blade root when the rotating blade is inserted. In this way, the guide section acts as a kind of flap against which the rotating blade root lies, so that the overall wear-resistant shield can be moved along with it when the rotating blade root is inserted in the axial direction. It is pointed out that here the guide section is designed to act in particular when the rotating blade is inserted into the rotor. When a rotating blade is being removed from the rotor, the guide section has no action and the rotating blade root can be moved in the axial direction of removal separately from the wear-resistant shield.

The above-mentioned object is furthermore achieved by a rotor for a gas turbine, especially an aircraft gas turbine, with a rotor base body, especially a rotating blade disk, in which at least one rotating blade root mount is formed, in which a rotating blade root of an associated rotating blade is arranged, and which is secured by an axial securing element, and with a wear-resistant shield with a base and two side walls connected to the base, wherein the side walls lie opposite each other in the peripheral direction and are shaped so as to be substantially complementary to an outer contour of the rotating blade root, and wherein the wear-resistant shield for this purpose is set up in such a way that, in an installed state, it can be taken up between the respective rotating blade root and the axial securing element, wherein it is proposed that the side walls of the wear-resistant shield project at least at one of their axial ends by a respective lateral end section beyond an axial end region of the base and that a guide section adjoins the axial end region of the base, this guide section proceeding from the base and being arced in the direction of the axial lateral end sections of the side walls, especially outward in the radial direction.

The axial securing element may have a first securing section and a second securing section, which are joined together by a securing base, wherein the first securing section is designed in such a way that it forms a first end stop for the rotating blade root in the axial direction, wherein the first securing section and the securing base are joined together by a curvature section, and wherein the guide section is arranged in the region of the curvature section between the rotating blade root and the axial securing element.

It is proposed, as an enhancement, that the first securing section and the securing base are oriented substantially orthogonal to each other, so that the curvature section has an arc length corresponding substantially to $\pi/2$ rad, wherein the arc length of the guide section of the wear-resistant shield is less than $\pi/2$ rad and greater than or equal to $\pi/4$ rad. Thanks to choosing the arc length of the guide section in the indicated range, it can be ensured that an adequate form-fitting abutment is provided between guide section and rotating blade root. Moreover, it is prevented in this way that the guide section lies in the region of the first securing section between the rotating blade root and the first securing section. This ensures a direct bearing of the rotating blade root against the first securing section.

The second securing section of the axial securing element may be designed such that it forms a second stop for the axial securing element on the rotor base body. In this way, the axial securing element may be inserted in the axial inserting direction as far as the second stop into the rotating blade root mount. According to one embodiment, the first securing section may extend radially outward and the second securing section may extend radially inward.

Moreover, the invention also relates to a gas turbine, especially an aircraft gas turbine with at least one rotor as described above. In this case, the rotor may be associated with the compressor or the turbine, especially a high-speed turbine or low-pressure turbine. "High-speed" means that the turbine is coupled to the fan by way of a gearing and rotates faster than the fan during operation. "Low-pressure" means that there is at least one additional turbine downstream from the combustion chamber, this turbine being associated with the low-pressure turbine upstream.

BRIEF DESCRIPTION OF THE DRAWING FIGURES

The invention shall be described below with reference to the enclosed figures by way of example and not in limiting fashion.

DESCRIPTION OF THE INVENTION

Figure 1:
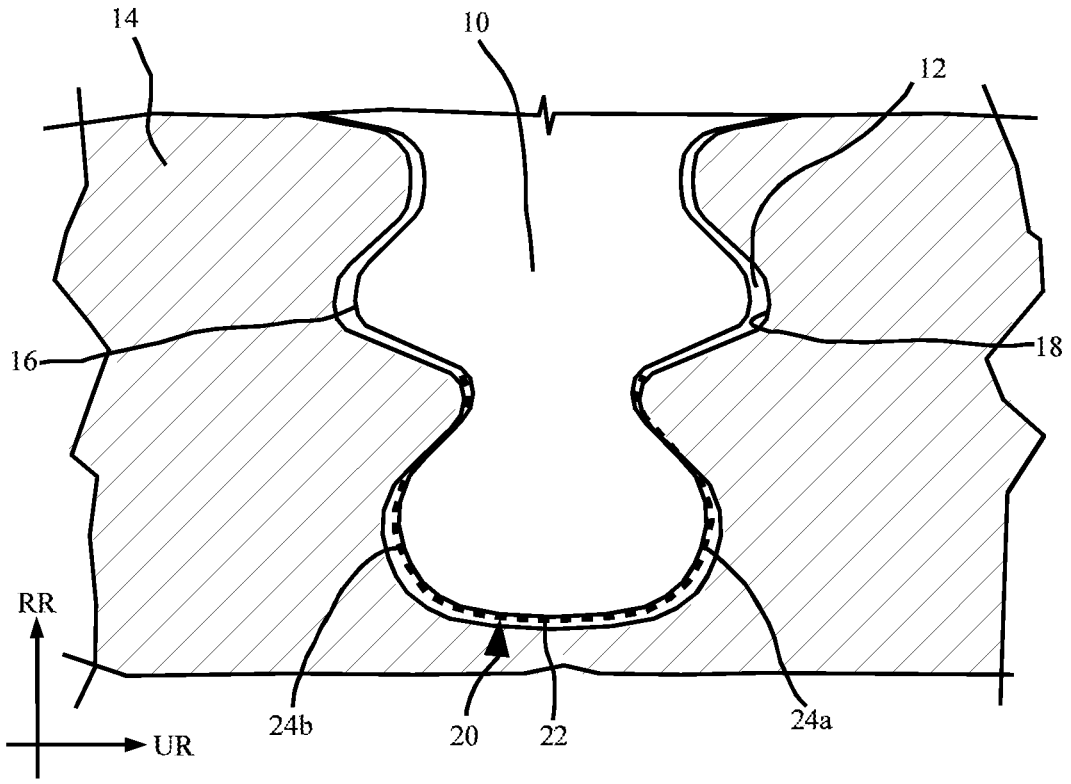
FIG. 1 shows a simplified and schematic cross-sectional representation of a rotating blade root in a rotating blade mount of a rotor.

In a schematic and highly simplified cross-sectional representation in the cross-sectional plane defined by the radial direction RR and peripheral direction UR, FIG. 1 shows a rotating blade root 10 of a rotating blade, which is not otherwise represented. The rotating blade root 10 is received in a rotating blade root mount 12 of a rotor 14. The rotor 14 may be designed as a rotor disk and several rotating blade root mounts 12 may be formed along its outer periphery, so that an overall rotating blade ring can be provided for the gas turbine.

The rotating blade root 10 has an outer contour 16, which is arranged in an inner contour 18 of the rotating blade root mount. The outer contour 16 and the inner contour 18 are formed substantially complementary to each other. The rotating blade root 10 is inserted into or removed from the rotating blade root mount 12 in the axial direction AR (substantially orthogonal to the cross-sectional plane of FIG. 1). The axial direction AR corresponds to the direction of the rotor's axis of rotation. It is pointed out that the represented shapes of the outer contour 16 and the inner contour 18 are purely qualitative. In particular, represented distances or spaces between these two contours 16, 18 may also be different from what is shown, for example, they may be smaller.

In order to protect the rotating blade root 10 against wear, a wear-resistant shield 20 may be arranged between the rotating blade root 10 and the rotating blade mount 12. In FIG. 1, such a wear-resistant shield 20 is indicated merely qualitatively by a broken line. It must be kept in mind that the broken line is not to be understood as meaning that the wear-resistant shield 20 is a component having interruptions. Instead, the wear-resistant shield generally has an uninterrupted material volume with regard to the cross-sectional representation of FIG. 1. The wear-resistant shield 20 has a shape which is formed substantially complementary to the rotating blade root 10, in particular, complementary to a radially inward situated region of the rotating blade root 10. It is also evident from the schematic cross-sectional representation of FIG. 1 that the wear-resistant shield 20 is generally not formed along the entire radial height of the rotating blade root 10.

Figure 2:
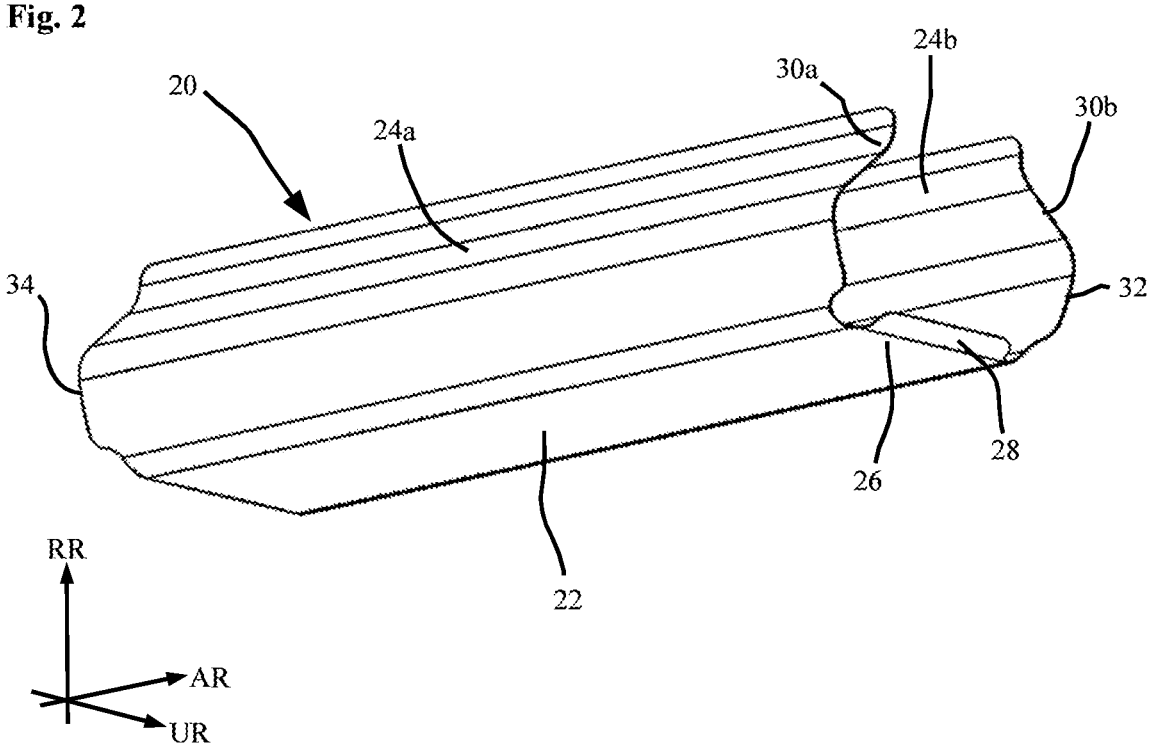
FIG. 2 shows in a simplified perspective representation one embodiment of a wear protection plate.

In a simplified and schematic perspective representation, FIG. 2 shows one embodiment of a wear-resistant shield 20. The wear-resistant shield comprises a base 22 and two side walls 24*a*, 24*b*. The base 22 and the side walls 24*a*, 24*b* may be formed as a single piece with each other. In particular, the wear-resistant shield 20 may be formed from a single machined piece of metal, such as one which is punched out and bent. The side walls 24*a*, 24*b* are formed such and have an outer shape that is adapted to an outer contour of a rotating blade root, which is not shown here. Purely schematically, refer once again to FIG. 1 in this regard, where the side walls 24*a*, 24*b* and the base 22 are likewise designated for sake of completeness, even though FIG. 1 does not show precisely the same embodiment as FIG. 2.

The base 22 extends substantially in the axial direction AR and in the peripheral direction UR. In the example of FIG. 2 shown here, the base 22 is formed as a surface in the plane that is defined by the axial direction AR and the peripheral direction UR (or a tangential direction to the peripheral direction). The base 22 need not absolutely be a planar surface; it may also have a curvature in whole or in part; for example, it may have a radially inward convex shape.

At an axial end or end section 26 of the base 22, there is arranged a guide section 28. The guide section 28 may also be formed as a single piece with the base 22. The guide section 28 has an arced or curved shape. The curvature here is formed concave on the side facing the rotating blade root. In other words, the guide section 28 is arced in the direction of the side walls 24*a*, 24*b*, especially in the direction of their lateral end sections 30*a*, 30*b*. With respect to an installed position on a rotor, the guide section 28 is bent radially outward.

The lateral end sections 30*a*, 30*b* project in the axial direction AR beyond the end section 26 of the base 22. This is particularly evident from FIG. 3, which shows a lateral top view of the side wall 24*b*. The guide section 28 is also evident in this figure. Since the lateral end sections 30*a*, 30*b* project in the axial direction beyond the base 22, it is possible to deform, in particular to bend the guide section 28, which also forms a kind of free end of the base 20. It is moreover evident from FIG. 3 that the guide section 28 in this embodiment is provided only at one axial end of the wear-resistant shield 20. This axial end may also be called the inserting end 32. The opposite axial end may be called the removal end 34 of the wear-resistant shield 20. This is due to the fact that the wear-resistant shield 20 is introduced or installed with the inserting end 32 in front along the axial direction AR into the rotating blade root mount. Even though the guide section 28 is represented only at the inserting end 32, this should not rule out a similar or identical section being provided also at the removal end 34, insofar as this is desired, for example, for the joint removal of rotating blade root and wear-resistant shield.

Figure 3:
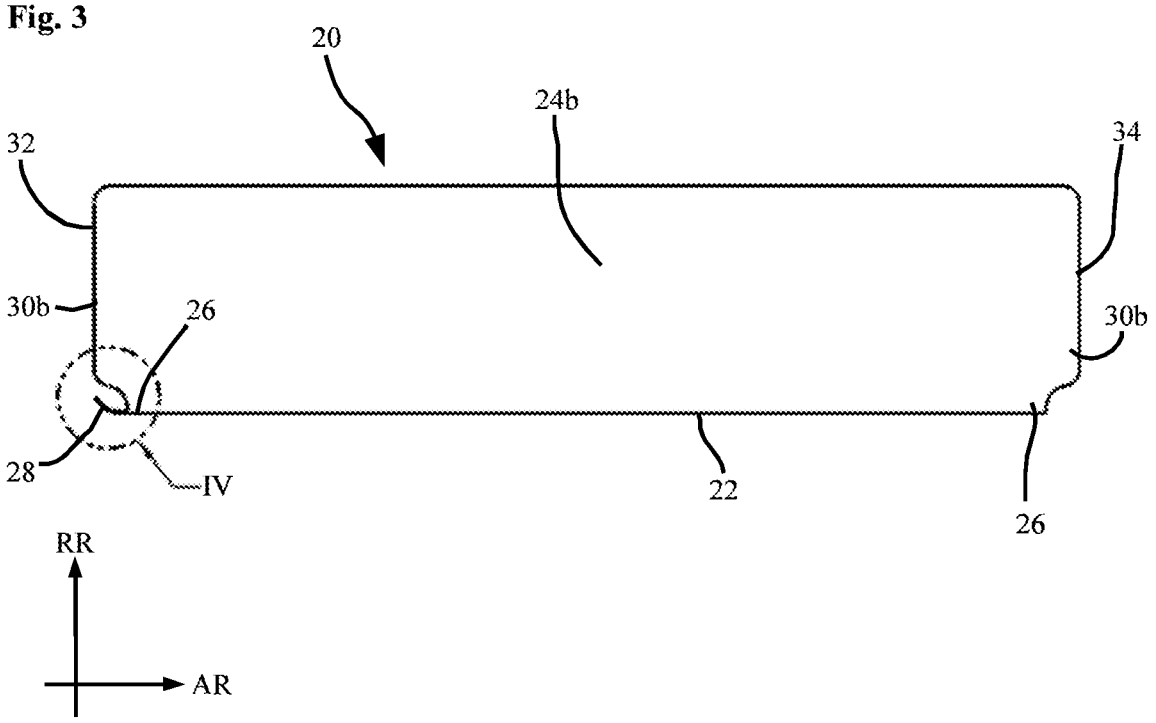
FIG. 3 shows the wear-resistant shield in a lateral top view.
Figure 4:
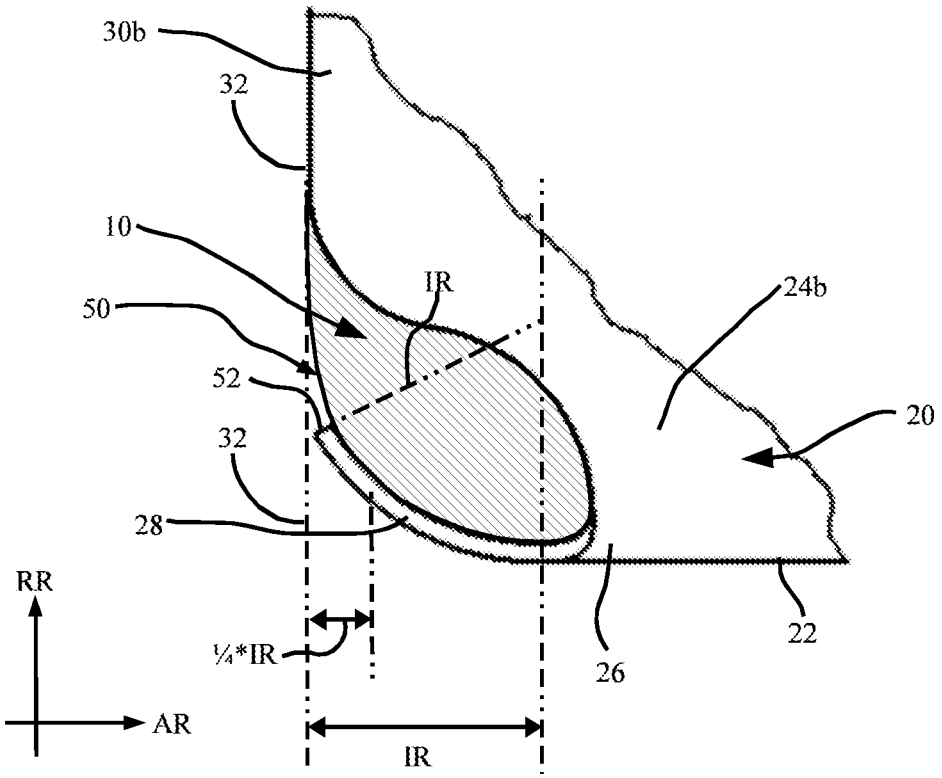
FIG. 4 shows a guide section of the wear-resistant shield of FIG. 3 in enlarged representation corresponding to the encircled region IV in FIG. 3.

FIG. 4 shows an enlarged representation of the guide section 28, roughly corresponding to the region designated as IV in FIG. 3. For purposes of illustration, the rotating blade root 10 is shown hatched. The guide section 28 is arced in such a way that its inner radius IR corresponds substantially to an outer radius of the rotating blade root 10 in this region. In this way, the rotating blade root 10 lies directly against the guide section 28 of the wear-resistant shield 20 in form-fitting manner.

If one projects the arced guide section 28 onto a line parallel with the axial direction AR, the length of the guide section 28 will lie in a region which is larger than or equal to 75% of the inner radius IR but smaller than the inner radius IR or equal to the inner radius IR. In other words, the guide section 28 extends radially outward at most up to the axial inserting end 32 of the wear-resistant shield, the end of the guide section being situated in a region that starts from the inserting end 32 and amounts to approximately 25% of the inner radius IR (=¼*IR).

Figure 5:
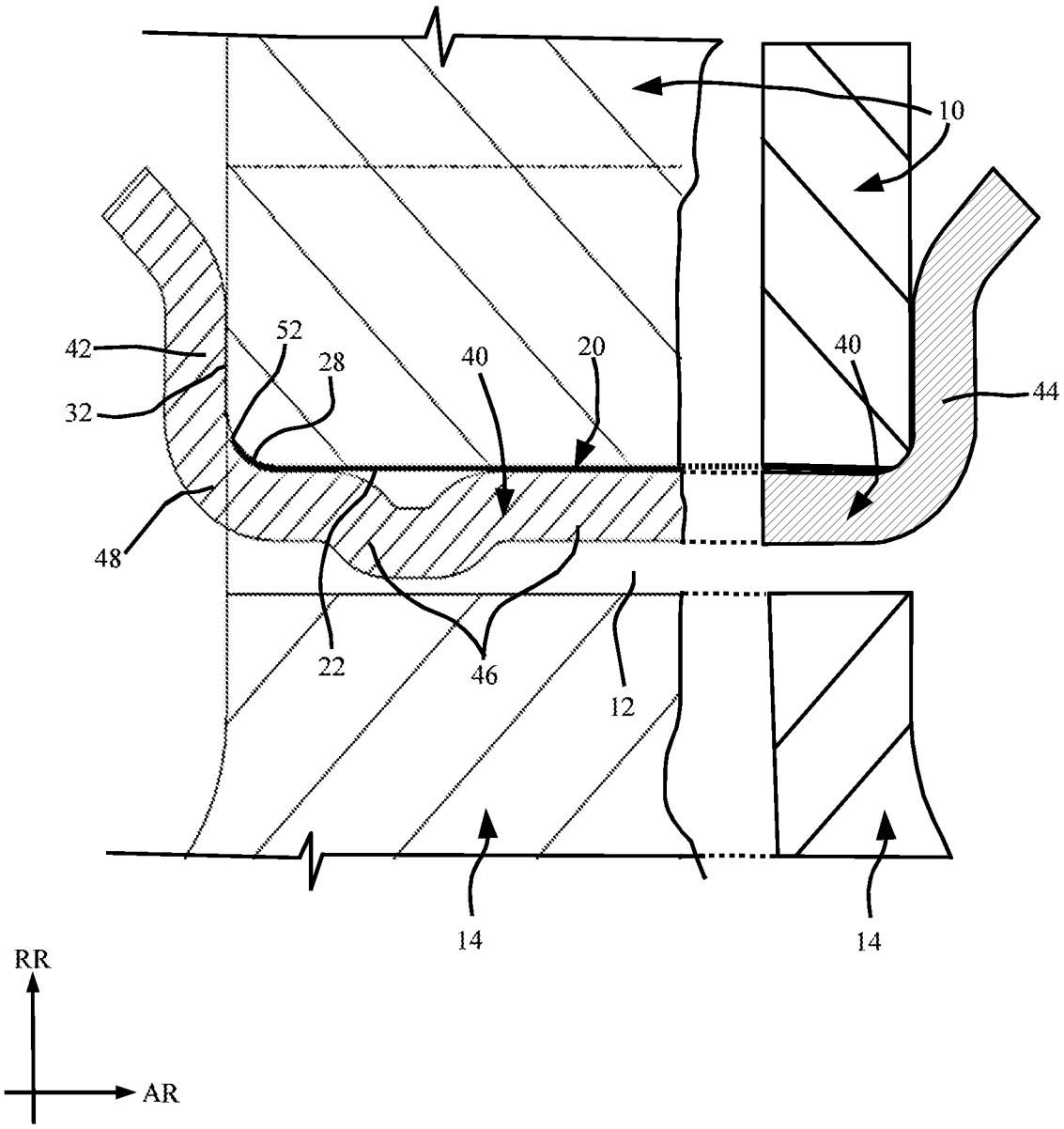
FIG. 5 shows a schematic and simplified cross-sectional representation through the rotating blade mount with inserted wear-resistant shield, axial securing element and rotating blade root.

FIG. 5 shows a cross-sectional representation of the rotating blade root 10, which is arranged or installed in the rotating blade root mount 12 of the rotor 14. The wear-resistant shield 20 is arranged between the rotating blade root mount 12 and the rotating blade root 10. Moreover, in this example, an axial securing element 40 is shown in addition. The axial securing element 40 is arranged between the wear-resistant shield 20 and the rotating blade root mount 12. The axial securing element 40 may also be called an axial securing plate. It comprises a first securing section 42, which is designed to serve as a first axial end stop or axial abutment surface for the rotating blade root 10. The first securing section 42 is arced radially outward. The axial securing element 40 also comprises a second securing section 44, which serves, in particular, to form a second axial end stop on the rotor 14. The second securing section 44 is arced radially outward. It is pointed out that the second securing section 44 is illustrated in FIG. 5 for purposes of better comprehension, without it being implied that the second securing section 44 must have precisely the configuration shown. Instead, other configurations of the second securing section 44 are also conceivable.

The axial securing element 40 moreover comprises a securing base 46, which extends between the first securing section 42 and the second securing section 44, substantially along the axial direction AR. The first securing section 42 is oriented substantially orthogonal to the securing base 46, in particular it extends substantially in the radial direction RR. A transition between the first securing section 42 and the securing base 46 is formed by a curvature section 48. The curvature section 48 has an arc length substantially corresponding to $\pi/2$ rad.

The guide section 28 of the wear-resistant shield is arranged or taken up between the curvature section 48 and the rotating blade root 10, especially at a rounded or curved radially inward edge 50 of the rotating blade root. The arc length of the guide section 28 of the wear-resistant shield 20 is less than $\pi/2$ rad and greater than or equal to $\pi/4$ rad.

As emerges from viewing FIGS. 4 and 5 together, the guide section 28 is dimensioned or arced or curved in such a way that its free end 52 does not project beyond the axial end 32 of the rotating blade root 10. In this way, it is ensured that the guide section 28 of the wear-resistant shield 20 is not arranged or clamped in the region running substantially in the radial direction RR between the first securing section 42 and the rotating blade root 10. Moreover, it is evident that the guide section 28 is dimensioned or arced or curved such that a sufficient form fit is assured with the rotating blade root 10, so that when the rotating blade root 10 is introduced into the rotating blade root mount 12 in the axial direction the wear-resistant shield 20 is moved optionally with the rotating blade root 10 as far as its end position shown in FIG. 5, in particular it is moved relative to the axial securing element 40. In terms of FIG. 5, the inserting direction runs from right to left.

Thus, the guide section 28 serves particularly so that, when introducing the rotating blade root 10, the wear-resistant shield 20 is, as it were, automatically brought into a desired or correct position relative to the rotating blade root mount 12 or the axial securing element 40. Accordingly, one may avoid having to correct the position of the wear protection plate 20 after installing the rotating blade root 10, which minimizes or even rules out the risk of damaging the wear-resistant shield 20.

It would be appreciated by those skilled in the art that various changes and modifications can be made to the illustrated embodiments without departing from the spirit of the present invention. All such modifications and changes are intended to be covered by the appended claims.

What is claimed is:

1. A wear-resistant shield for a rotating blade root of a rotating blade of a gas turbine, comprising:

a rotating blade root having a blade root mount of a rotor;

the wear-resistant shield, comprising, a base; and two side walls connected to the base, wherein the side walls lie opposite each other and are shaped so as to be substantially complementary to an outer contour of a rotating blade root; and an axial securing element;

wherein the wear-resistant shield, in an installed state, is disposed between a respective rotating blade root and a rotating blade root mount of a rotor, and the wear-resistant shield is disposed between the respective rotating blade root and the axial securing element arranged in the rotating blade root mount;

wherein the two side walls project at least at one of their axial ends by a respective lateral end section beyond an axial end of the base and a guide section extends from the axial end of the base, the guide section starting from the base and arcing in the direction of the axial end of the side walls.

2. The wear-resistant shield as claimed in claim 1, wherein the guide section is arced to have substantially the same curvature as a rotating blade root region in contact with or coming into contact with the guide section.

3. The wear-resistant shield as claimed in claim 1, wherein the guide section has a projected length, in terms of a projection onto an axial direction, corresponding to approximately 0.75 to 1.0 times a radius by which the guide section is arced.

4. The wear-resistant shield as claimed in claim 1, wherein the guide section is located at an axial inserting end of the rotating blade root so that the wear-resistant shield and the associated rotating blade root are movable together in the axial inserting direction relative to the respective rotating blade root mount of the rotor.

5. A rotor for a gas turbine, comprising:

a rotor base body with at least one rotating blade root mount, in which a rotating blade root of an associated rotating blade is arranged, and which is secured by an axial securing element, and with a wear-resistant shield with a base and two side walls connected to the base, wherein the side walls lie opposite each other in the peripheral direction and are shaped so as to be substantially complementary to an outer contour of the rotating blade root, and wherein the wear-resistant shield is configured and arranged, in an installed state, to be taken up between the respective rotating blade root and the axial securing element;

the side walls of the wear-resistant shield project at least at one of their axial ends by a respective lateral end section beyond an axial end of the base and in that a guide section extends from the axial end of the base, the guide section extending from the axial end of the base and arcing in the direction of the axial lateral end sections of the side walls and arcing outward in the radial direction.

6. The rotor as claimed in claim 5, wherein the axial securing element has a first securing section and a second securing section, which are joined together by a securing base, wherein the first securing section is configured and arranged such that it includes a first end stop for the rotating blade root in the axial direction, wherein the first securing section and the securing base are joined together by a curvature section, and wherein the guide section is arranged in the region of the curvature section between the rotating blade root and the axial securing element.

7. The rotor as claimed in claim 6, wherein the first securing section and the securing base are oriented substantially orthogonal to each other, so that the curvature section has an arc length corresponding substantially to $\pi/2$ rad, wherein the arc length of the guide section of the wear-resistant shield is less than $\pi/2$ rad and greater than or equal to $\pi/4$ rad.

8. The rotor as claimed in claim 6, wherein the second securing section of the axial securing element includes a second stop for the axial securing element on the rotor base body.

9. The rotor as claimed in claim 5, wherein at least one of the rotor is configured and arranged in an aircraft gas turbine.

10. The rotor as claimed in claim 9, wherein the at least one of the rotor is configured and arranged in a compressor or a high-speed low-pressure turbine of the aircraft gas turbine.

* * * * *